US006074206A

United States Patent [19]

Lauersdorf

[11] Patent Number: 6,074,206

[45] Date of Patent: Jun. 13, 2000

[54] INDUSTRIAL OVEN WITH BI-DIRECTIONAL EXPANSION JOINTS

[75] Inventor: Duane H. Lauersdorf, Watertown, Wis.

[73] Assignee: Wisconsin Oven Corporation, East Troy, Wis.

[21] Appl. No.: 09/193,592

[22] Filed: Nov. 17, 1998

[51] Int. Cl.[7] ..... F27D 1/00

[52] U.S. Cl. ..... 432/251; 432/247; 432/252; 110/331; 110/336

[58] Field of Search ..... 432/247, 248, 432/251, 252; 110/331, 332, 336; 126/65, 21 R, 19 R; 52/275, 270, 285.1, 712; 403/13, 14, 28, 30

[56] References Cited

U.S. PATENT DOCUMENTS

| | | | |
|---|---|---|---|
| 3,240,173 | 3/1966 | Bunge | 110/332 |
| 4,035,093 | 7/1977 | Redshaw | 403/4 |
| 4,311,460 | 1/1982 | Lauersdorf et al. | 432/247 |
| 4,524,702 | 6/1985 | Miller et al. | 110/173 A |
| 4,764,108 | 8/1988 | Carthew et al. | 432/128 |
| 5,303,660 | 4/1994 | Lauersdorf | 110/336 |
| 5,475,958 | 12/1995 | Josefsson et al. | 52/396.01 |
| 5,876,006 | 3/1999 | Sharp et al. | 248/297.21 |

*Primary Examiner*—Denise L. Ferensic
*Assistant Examiner*—Jiping Lu
*Attorney, Agent, or Firm*—Nilles & Nilles, S.C.

[57] ABSTRACT

An industrial oven uses bi-directional expansion joints to accommodate lateral and longitudinal movement intersecting support beams of the oven's structural framework resulting from expansion of the support beams, the supported beams, and/or other oven components. The intersecting support beams may, for instance, comprise either roof purlins 1) and underlying roof trusses or 2) floor support members and underlying oven base support beams. Each bi-directional expansion joint includes a bracket permitting relative longitudinal and lateral movement between the support beams and the associated supported beams. The brackets preferably comprise L-shaped brackets each having 1) a vertical leg connected to the associated supported beam(s), 2) a horizontal leg connect to the associated support beam, and 3) expansion slots permitting lateral movement between the support beam and the bracket and longitudinal movement between the supported beam(s) and the bracket.

24 Claims, 7 Drawing Sheets

INDUSTRIAL OVEN WITH BI-DIRECTIONAL EXPANSION JOINTS

BACKGROUND OF THE INVENTION

1. Field of the Invention

The invention relates to industrial ovens for drying, finishing, or heat-treating relatively large products and, more particularly, relates to an industrial oven having expansion joints permitting both lateral and longitudinal movement between intersecting structural components thereof resulting from expansion of those or other components.

2. Discussion of the Related Art

Industrial ovens are well-known in the art for drying, finishing, and/or heat-treating a wide variety of items of many different sizes. Depending on the application, these ovens typically are heated to temperatures of up to about 800° F., and are very large—on the order of 20–100' long by 20–30' wide by 10–20' high.

The typical oven includes a floor assembly, front, rear, left, and right side walls, and a roof assembly. At least the walls and the roof assembly typically take the form of inner and outer metal shells separated from one another by a layer of insulation. The extreme temperature changes encountered by these ovens, coupled with their relatively large size, leads to significant expansion of not only the inner and outer shells, but also of the steel components of their structural framework. The problem of accommodating structural expansion of the shells is addressed, for example, in U.S. Pat. No. 4,311,460 ('460 patent) to Lauersdorf and U.S. Pat. No. 5,259,758 to Lauersdorf. These patents also incorporate measures to permit longitudinal expansion of portions of an oven's structural steel framework. For instance, the Lauersdorf '460 patent employs expansion slots at the joints between girts of the walls and between the vertical columns on which the girts are supported. Similarly, U.S. Pat. No. 4,764,108 to Carthew and U.S. Pat. No. 5,475,958 to Josefsson both disclose modular ovens having a plurality of longitudinally-aligned sections each of which is connected to an adjacent section at an expansion joint, permitting longitudinal expansion of the adjacent sections relative to one another. However, none of these patents incorporates measures to permit relative lateral and longitudinal movement between intersecting support beams of its structural steel framework resulting from expansion of one or both of the intersecting beams and/or other components of the oven. This limitation proves problematic in oven designs in which some heated beams, such as roof purlins or floor support members, are supported on and run perpendicularly with respect to other beams, such as roof trusses or oven base support beams. It is possible that either or both of a pair of connected intersecting beams can expand from between 1" to 2" during operation of the oven. No prior known oven design incorporates measures to accommodate this degree of relative bi-directional movement between two intersecting support beams.

OBJECTS AND SUMMARY OF THE INVENTION

It is therefore a principal object of the invention to provide an industrial oven that incorporates measures to accommodate both longitudinal and lateral expansion at joints between two intersecting support beams of the oven.

A second object of the invention is to provide an industrial oven that meets the first principal object, that uses inexpensive-to-manufacture parts, and that is relatively easy to assemble.

A third object of the invention is to provide an industrial oven that meets the first principal object and that is of a versatile design, permitting the expansion joints thereof to be used in a wide variety of different applications.

In accordance with a first aspect of the invention, this object is achieved by providing an oven including a floor assembly, a plurality of insulated vertically-extending walls which are supported on the floor assembly, and an insulated roof assembly which is disposed above the floor assembly and the walls. At least one of the floor assembly and the roof assembly includes 1) a plurality of support beams which extend laterally of the oven, 2) a plurality of supported beams which extend longitudinally of the oven, which are disposed above the support beams, and which are supported on the support beams, and 3) a plurality of bi-directional expansion joints, each of which permits relative longitudinal and lateral movement between the associated support beam (s) and the associated supported beam(s). Each joint includes a bracket which connects the associated supported beam(s) to the associated support beam(s). The brackets permit relative bi-directional movement between the support beams and the supported beams so as to accommodate expansion of the support beams, the supported beams, and/or other internal components of the oven.

Preferably, each bracket has 1) a first portion bolted to the associated supported beam via a first slot-and-bolt arrangement which permits longitudinal movement of the supported beam relative to the bracket, and 2) a second portion bolted to the associated support beam via a second slot-and-bolt arrangement which permits lateral movement of the support beam relative to the bracket. In a particularly preferred arrangement, each bracket is L-shaped so as to have a vertical leg and a horizontal leg, the vertical leg having an elongated longitudinal slot which is formed therethrough and through which the bracket is bolted to an associated supported beam, and the horizontal leg having an elongated lateral slot which is formed therethrough and through which the bracket is bolted to an associated support beam.

A second principal object of the invention is to provide a roof assembly for an industrial oven that incorporates measures to permit relative longitudinal and lateral expansion between roof trusses of the roof assembly and roof purlins mounted on the trusses.

In accordance with another object of the invention, this object is achieved by providing a roof assembly in which a plurality of brackets connect the roof purlins of the assembly to the roof trusses of the assembly. The brackets permit bi-directional movement between the roof trusses and the roof purlins so as to accommodate expansion of the roof trusses laterally of the oven and expansion of the roof purlins longitudinally of the oven.

A third principal object of the invention is to provide a floor assembly for an industrial oven that permits relative longitudinal and lateral movement between oven base support beams of the floor assembly and floor support members mounted on the oven base support beams.

In accordance with still another aspect of the invention, this object is achieved by providing a floor assembly in which a plurality of brackets connect the floor support beams of the assembly to the oven base support beams of the assembly. The brackets permit relative bi-directional movement between the oven base support beams and the floor support beams so as to accommodate longitudinal expansion of the floor support beams, and lateral expansion of an inner floor shell or other structure mounted on the floor support beams.

These and other objects, features, and advantages of the present invention will become apparent to those skilled in the art from the following detailed description and drawings. It should be understood, however, that the detailed description and specific examples, while indicating preferred embodiments of the invention, are given by way of illustration and not of limitation. Many changes and modifications may be made within the scope of the present invention without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout, and in which.

DETAILED DESCRIPTION OF THE PREFERRED EMBODIMENTS

1. Resume

Pursuant to the invention, a preferred embodiment of an industrial oven uses bi-directional expansion joints to accommodate lateral and longitudinal movement of intersecting support beams of the oven's structural framework resulting from expansion of one or both of the beams and/or from other components of the oven connected to those beams. The intersecting support beams may, for instance, comprise either roof purlins 1) and underlying roof trusses or 2) floor support members and underlying oven base support beams. Each bi-directional expansion joint includes a bracket permitting relative longitudinal and lateral movement between the support beams and the associated supported beams. The brackets preferably comprise L-shaped brackets each having 1) a vertical leg connected to the associated supported beam(s), 2) a horizontal leg connect to the associated support beam, and 3) expansion slots permitting lateral movement between the support beam and the bracket and longitudinal movement between the supported beam(s) and the bracket.

2. Overview and Oven Construction

Figure 1:
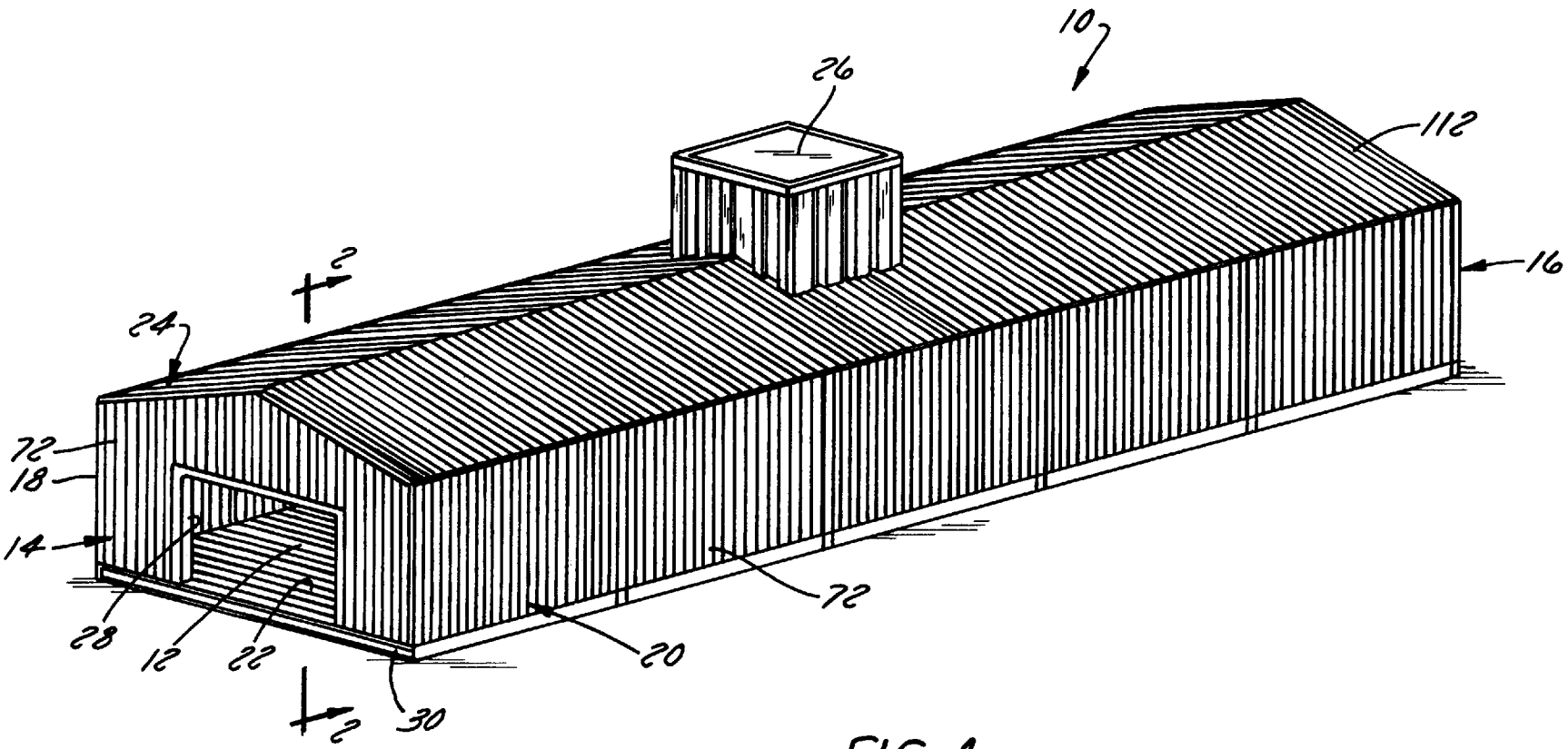
FIG. 1 is a perspective view of an industrial oven constructed in accordance with a preferred embodiment of the invention.
Figure 2:
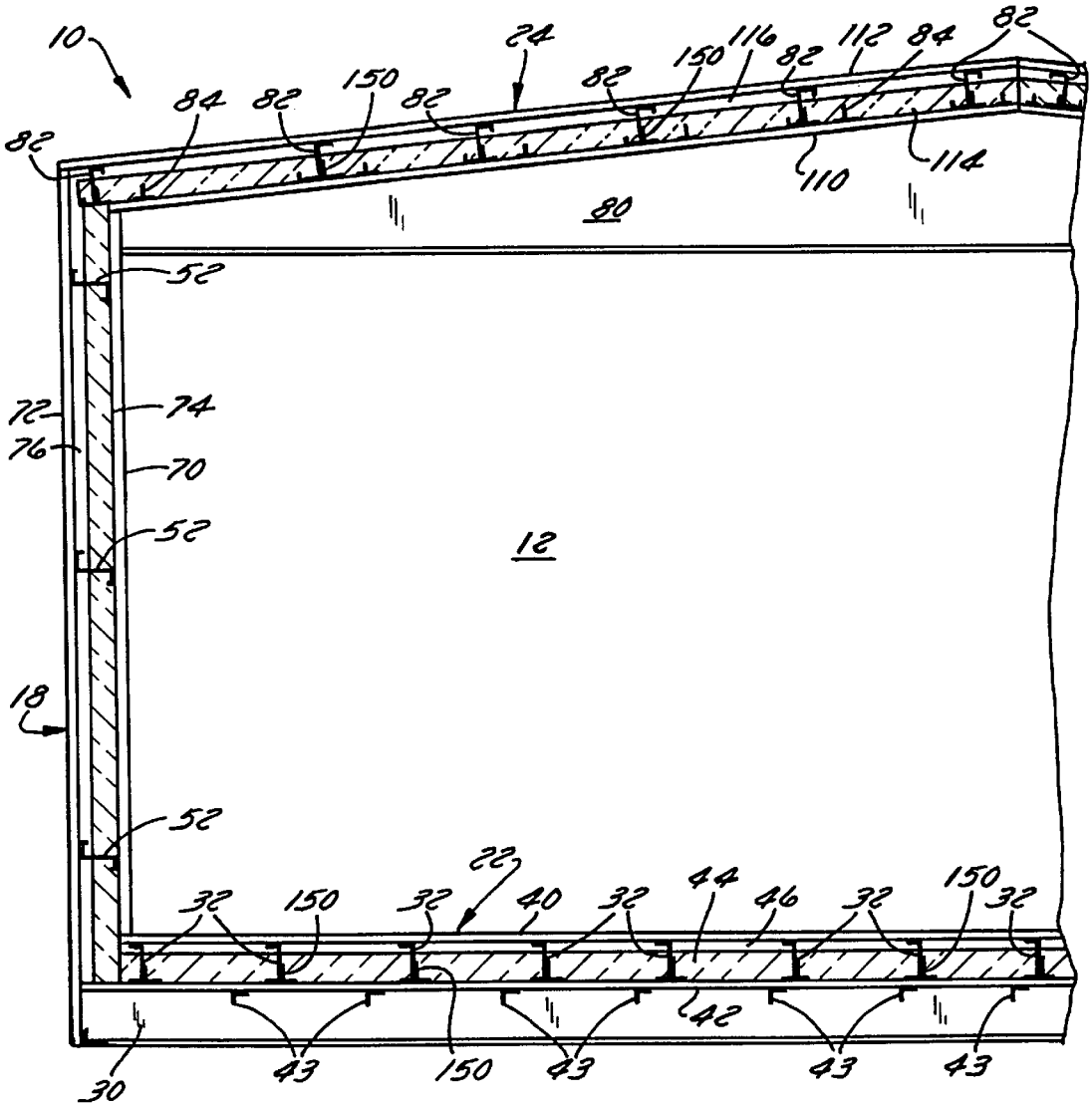
FIG. 2 is a sectional end elevation view of a portion of the oven of FIG. 1, taken generally along the lines 2—2 in FIG. 1.

The invention is applicable to any industrial oven in which the need exists to accommodate bi-directional relative movement between intersecting support beams of the oven in response to expansion of one or both of the beams and/or of other members of the oven connected to those beams. Referring initially to FIGS. 1 and 2, one such oven 10 is of the type having a heated interior 12 bordered by 1) front, rear, left-side, and right-side walls 14, 16, 18, and 20, respectively; 2) an insulated floor assembly 22; and 3) an insulated roof assembly 24. The interior 12 of the oven 10 is heated via operation of a heater (not shown) disposed in a heater housing 26 mounted on top of the roof assembly 24, a sidewall assembly 18 or 20, or one of the end wall assemblies 14 or 16. In the illustrated embodiment in which the oven 10 is designed for use as a finishing oven, the heater heats the interior 12 to a temperature of between about 350° F. and about 500° F. However, the invention also applies to low-end heat-treatment ovens and other ovens heating articles to higher temperatures of up to about 800° F. The interior 12 of the oven 10 is large enough (approximately 100' long by 30' wide by 15' high) to accommodate large parts such as aircraft wings or fuselage parts.

The illustrated oven 10 is a single-pass oven having a single entrance doorway 28 in the front wall 14 and a single exit doorway (not shown) in the rear wall 16. In practice, both doorways would be closed by insulated doors (not shown) during finishing or heat treatment operations. However, the invention is equally applicable to two-pass ovens or multi-pass having two doors at one or both ends. In fact, the article entrance location, article exit location, and travel path of the article through the oven may vary dramatically from application-to-application, and the invention applies to all such applications. For instance, the invention is applicable to bottom-loading ovens having an entrance and/or exit in the floor assembly of the oven. Articles may be conveyed through the oven 10 by a suspended chain drive arrangement, a floor-mounted rail arrangement, or any other conventional arrangement.

3. Construction of Floor Assembly

Referring now particularly to FIGS. 2 through 6, the floor assembly 22 includes 1) a structural framework arrangement supporting the remainder of the oven 10 and 2) a double-shell floor arrangement which is mounted on the structural framework arrangement. Each of these arrangements will be described in turn.

The structural framework arrangement comprises a plurality of steel oven base support beams 30 and a plurality of steel floor support beams 32. The oven base support beams 30 comprise I-beams, each extending laterally across the full thirty foot width of the oven 10. Six such beams are provided at twenty foot intervals along the length of the oven 10. The floor support beams 32 extend longitudinally or at least generally orthogonally to the oven base support beams 30 so as to intersect the oven base support beams 30. Fifteen rows of floor support beams 32 are provided at approximately one-foot intervals. In the illustrated embodiment, each of the floor support beams 32 is approximately twenty feet long and generally C-shaped when viewed in transverse cross section so as to include a web 34 and upper and lower legs 36 and 38 extending horizontally from a common side of the web 34. The floor support beams 32 are connected to the oven base support beams 30 at each joint or point of intersection by a bi-directional expansion joint 150 detailed in Section 6 below. Gaps are formed between the ends of adjacent floor support beams 32 in each row to accommodate expansion of the longitudinally adjacent beams relative to one another.

Figure 3:
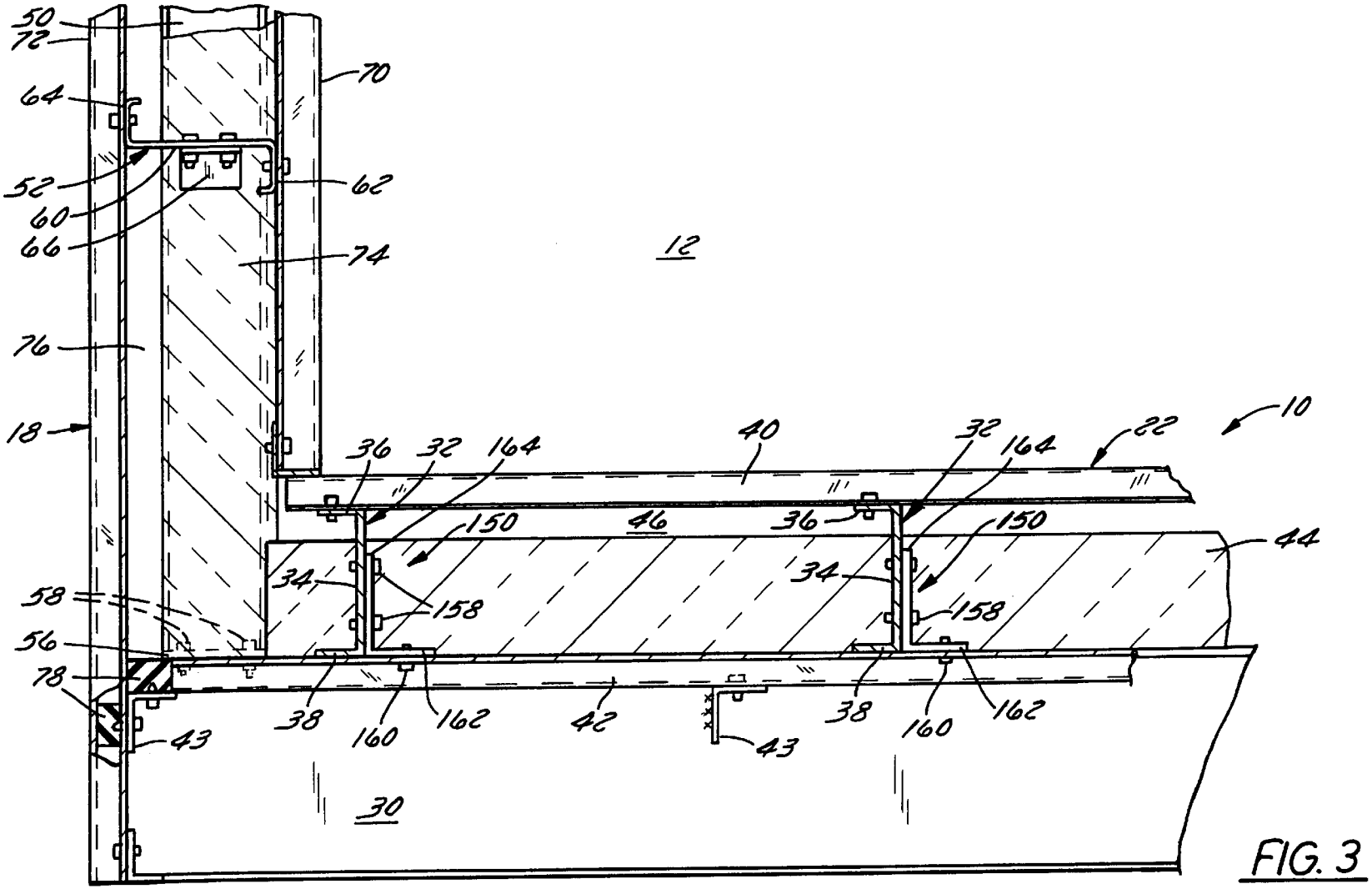
FIG. 3 is a sectional end elevation view of a lower corner portion of the oven, illustrating an intersection between a floor assembly of the oven and the left side wall of the oven.

The double-shell floor arrangement includes an inner shell 40 and an outer shell 42. The outer shell 42 comprises a plurality of corrugated sheets affixed to clips 43 which in turn are affixed to the oven base support beams 30 as best seen in FIG. 3. In the illustrated embodiment in which articles are designed to be conveyed through the oven 10 by a suspended chain assembly and, hence, need not be supported directly on the floor assembly 22, the inner shell 40 also comprises a plurality of corrugated sheets affixed to the upper legs 36 of the floor support members 32. However, the inner sheets may be covered with segmented flat plates to provide walkways or other supports for structures directly on the inner shell 40 of the floor assembly 22. The sheets of both the inner and outer shells 40 and 42 are affixed to the floor support members 32 so as to permit sheet expansion as discussed in more detail in Section 4 below in connection with the walls. Finally, a layer of batt-type insulation 44 is sandwiched vertically between the inner and outer shells 40 and 42 and horizontally between the adjacent rows of floor support members 32. An air gap 46 preferably is formed between the insulation 44 and one of the inner and outer shells 40 and 42 (the inner shell 40 in the present case) to further inhibit heat transfer through the floor assembly 22.

4. Construction of Walls

The front wall 14, rear wall 16, left-side wall 18, and right-side wall 20 are all of similar construction. Each includes a structural framework arrangement and a double-shell insulated wall arrangement supported on the structural framework arrangement. Each of these arrangements will now be described in turn.

Figure 4:
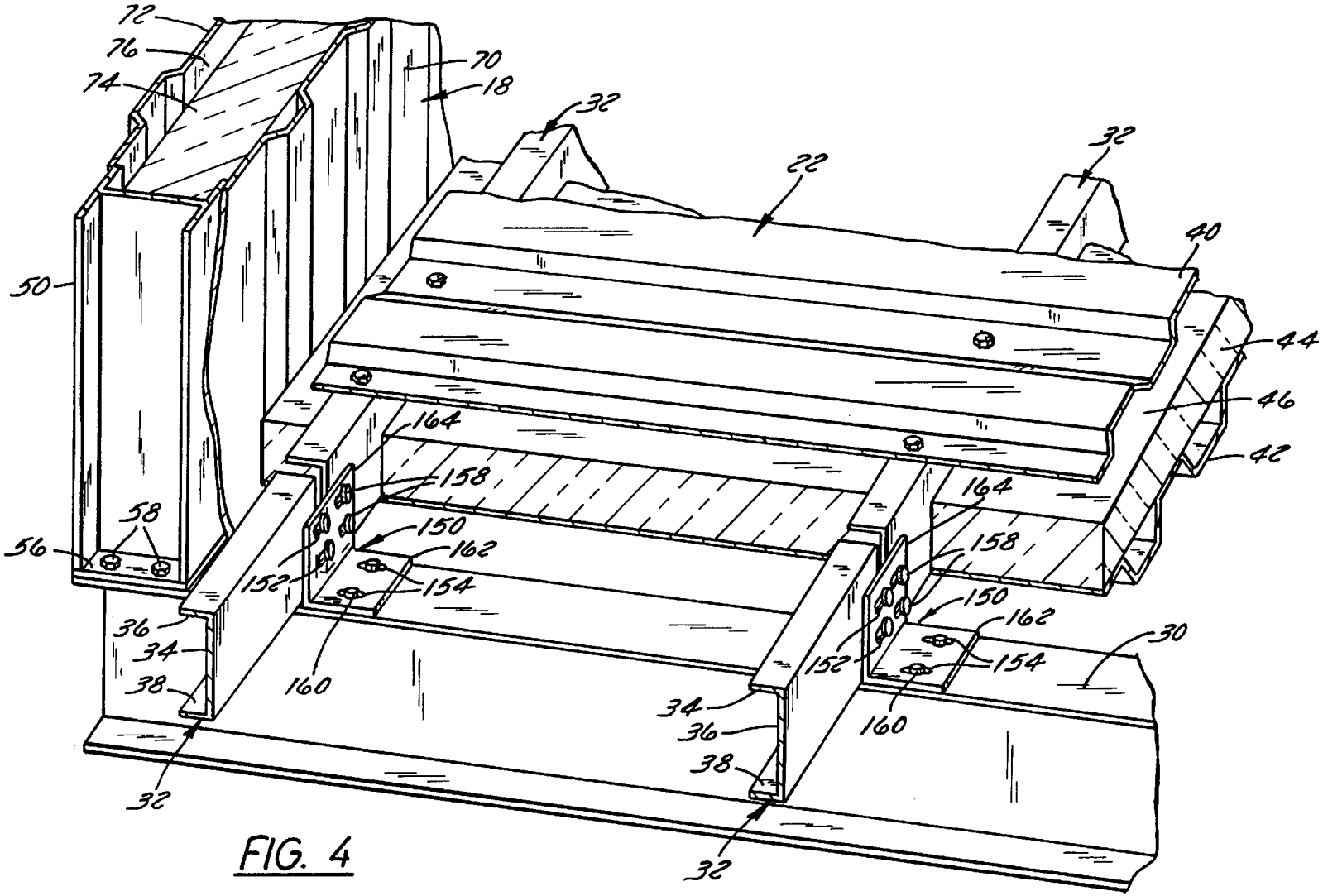
FIG. 4 is a fragmentary, partially cut-away perspective view of the portion of the oven generally illustrated in FIG. 3.
Figure 5:
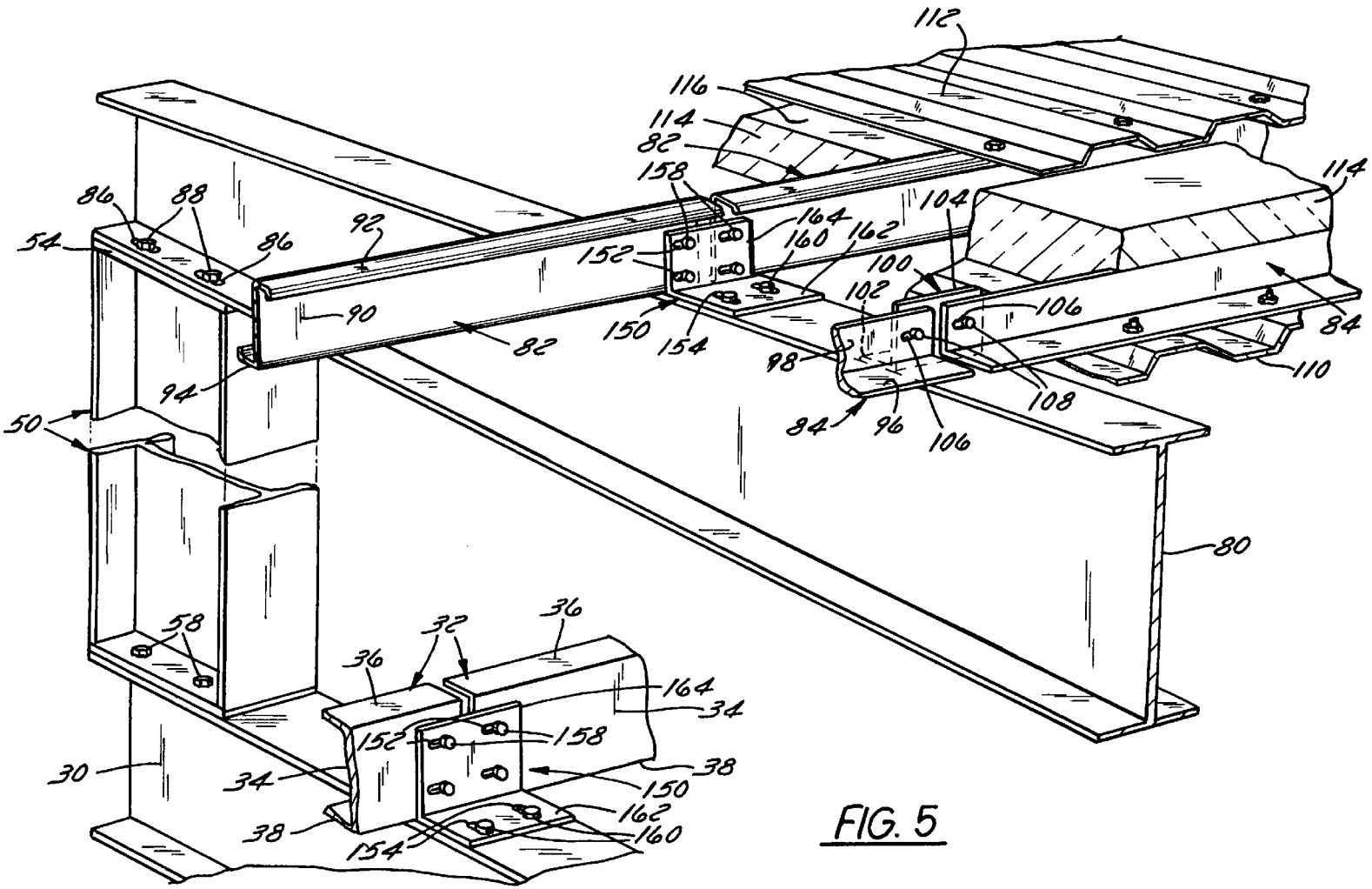
FIG. 5 is a fragmentary, partially cut-away perspective view of a portion of the left side wall, an adjacent portion of the floor assembly and an adjacent portion of a roof assembly of the oven.
Figure 6:
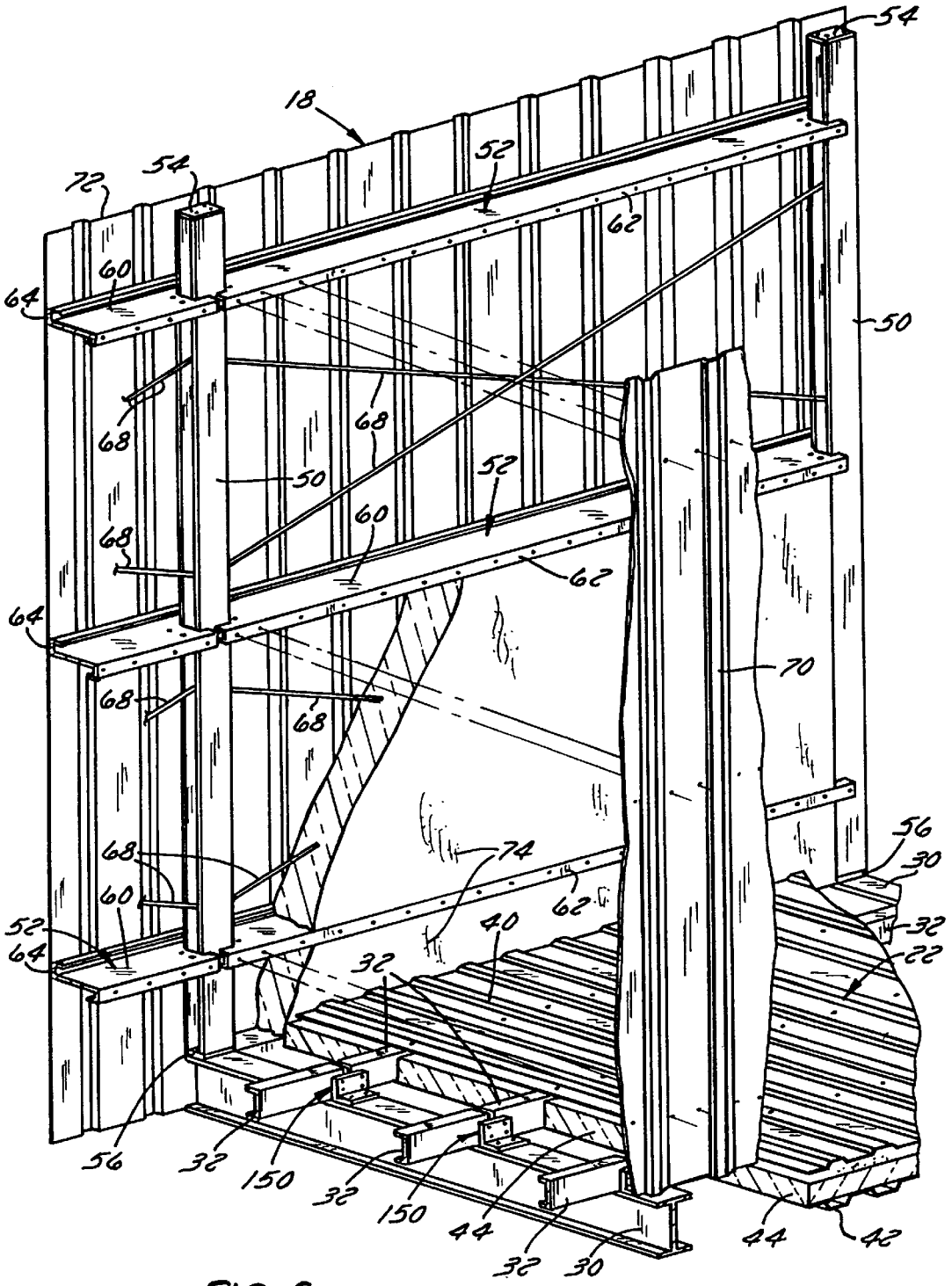
FIG. 6 is a partially exploded, partially cut-away fragmentary perspective view of another portion of the oven, including a portion of the left side walls and a portion of the floor assembly.
Figure 7:
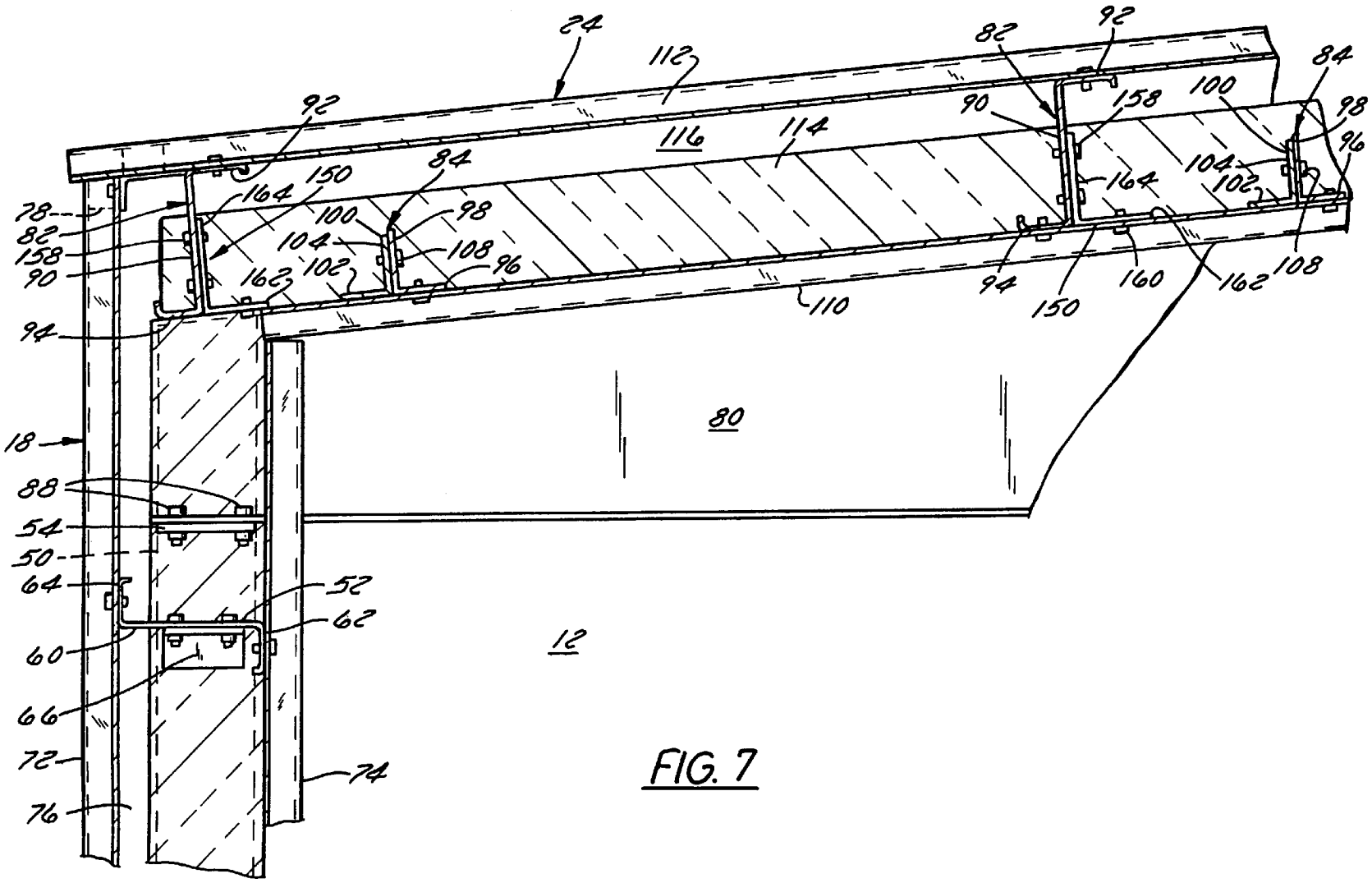
FIG. 7 is a fragmentary sectional end elevation view of an upper corner portion of the oven of FIGS. 1 and 2, illustrating an intersection between the roof assembly of the oven and the left side wall of the oven.

Referring to FIGS. 2–7, the structural framework arrangement of each wall includes a plurality of vertical steel support columns 50 and at least one horizontal steel girt 52. In the side walls 18 and 20, six support columns 50 are provided at twenty foot intervals (this spacing is reduced in the front wall 14 and the rear wall 16 to accommodate doorways). Each support column 50 comprises an I-beam terminating at its top and bottom ends in respective support plates 54 and 56, best seen in FIG. 5. The bottom support plate 56 of each support column 50 is anchored to an end of one of the oven base support beams 30 by a plurality of bolts 58. This connection need not accommodate relative expansion-based movement between the oven base support beam 30 and the support column 50 because 1) the oven base support beam 30 and the bottom support plate 56 are exposed to only limited heat, and 2) the bottom support plate 56 is relatively small when compared to the other components of the oven 10. Each girt 52 preferably is identical to the so-called "Z-beams" or "Zs" disclosed in the Lauersdorf '460 patent. Referring particularly to FIGS. 3, 6, and 7, each girt 52 therefore includes 1) a horizontal web 60, 2) an inner leg 62 extending downwardly from an inner edge of the horizontal web 60, and 3) an outer leg 64 extending upwardly from an outer edge of the horizontal web 60. Girt expansion is accommodated by mounting the girts 52 on the columns 50 by expansion clips 66 as described in the Lauersdorf '460 patent. Finally, if desired, a plurality of diagonally-extending bracing rods 68 (FIG. 6) can be incorporated into the double-shell wall arrangement for added rigidity. Each of the rods 68 extends vertically from an upper end of one column 50 to a lower end of an adjacent column.

Referring to FIGS. 2–4, 6, and 7, the insulated double-shell wall arrangement of each wall is identical to the corresponding insulated wall structure of the Lauersdorf '460 patent and includes an inner shell 70, an outer shell 72, and a layer of insulation 74. The inner shell 70 comprises a plurality of corrugated sheets attached to the inner surfaces of the adjacent support columns 50 and to the inner legs 62 of the girts 52. The outer shell 72 similarly comprises a plurality of corrugated sheets attached to the outer surfaces of the adjacent support columns 50 and to the outer legs 64 of the girts 52. Lateral and longitudinal expansion of the sheets are accommodated in the same manner as they are accommodated in the corresponding sheets of the floor assembly 22 as well as in the sheets or panels disclosed in the Lauersdorf '460 patent. The insulation 74 preferably comprises batt-type insulation sandwiched longitudinally between adjacent support columns 50 and laterally between the inner and outer shells 70 and 72. Preferably, wires or the like (not shown) hold the insulation 74 to the inner shell 70, thereby providing a dead air space 76 between the outer surface of the insulation 74 and the outer shell 72 to provide additional resistance to heat transfer. Finally, a rubber weather seal 78 seals each edge of the outer shell 72 to an edge of the outer shell of an adjoining section of the oven 10.

5. Construction of Roof Assembly

Referring now to FIGS. 2, 5, and 7, the roof assembly 24 is mounted on the upper support plates 54 of the vertical support columns 50 so as to cover the interior 12 of the oven 10 and to support the heater housing 26. The roof assembly 24 includes 1) a structural framework arrangement similar to that found in the floor assembly 22 and 2) a double-shell wall arrangement similar to that found in the walls 14, 16, 18, and 20 and in the floor assembly 22. Each of these arrangements will be described in turn.

The structural framework arrangement includes a plurality of laterally extending steel roof trusses 80, a plurality of longitudinally extending steel roof purlins 82 mounted on top of the roof trusses 80, and a plurality of longitudinally extending steel inner sheet support members 84 mounted on top of the roof trusses 80. Each of the roof trusses 80 comprises a unitary steel I-beam that is generally trapezoidal in shape so as to have a triangular upper surface and a horizontal lower surface. Each of the roof trusses 80 extends the full thirty-foot width of the oven 10. As with the oven base support beams 30 and the vertical support columns 50, six roof trusses 80 are provided, spaced at twenty-foot intervals along the length of the oven 10. As best seen in FIG. 5, the ends of the roof trusses 80 are attached to the top support plates 54 of the support columns 50 by slot-and-bolt arrangements that permit expansion and contraction of the roof trusses 80 laterally relative to the oven 10. Each such slot-and-bolt arrangement includes 1) an elongated slot 86 formed in the bottom leg of the roof truss 80 and 2) a bolt 88 extending through the elongated slot 86 and into a circular aperture in the upper support plate 54 of the associated support column 50.

The roof purlins 82 are provided in ten longitudinally-extending rows that are spaced at three-to-four foot intervals across the width of the oven 10. Each roof purlin 82 is generally Z-shaped when viewed in transverse cross section, having 1) a vertical web 90, 2) an upper leg 92 extending horizontally from a first side of the web 90, and 3) a lower leg 94 extending horizontally from a second side of the web 90. The roof purlins 82 are mounted on the upper ends of the roof trusses 80 by bi-directional expansion joints 150 described in more detail in Section 6 below. A gap is formed between the ends of adjacent purlins 82 of each row to accommodate thermal expansion of the longitudinally adjacent purlins 82 relative to one another.

As best seen in FIGS. 5 and 7, the inner sheet support members 84 are arranged in rows of twenty foot long members. Each row is located adjacent to and parallel with a corresponding row of roof purlins 82. Each inner sheet support member 84 is generally L-shaped, having 1) a horizontal leg 96 supported on the roof trusses 80 and 2) a vertical leg 98. The opposite ends of each vertical leg 98 are attached to the upper surface of an associated roof truss 80 by an expansion clip 100. Each such expansion clip 100 is L-shaped, having 1) a horizontal leg 102 welded, bolted, or otherwise rigidly affixed to the top of the roof truss 80, and 2) a vertical leg 104 affixed to the vertical leg 98 of the end of two adjacent inner sheet support members 84 by elongated slot-and-bolt arrangements. Each such slot-and-bolt arrangement includes 1) an elongated slot 106 that is formed in the vertical leg 98 of the inner sheet support member 84 and 2) a bolt 108 that extends through the elongated slot 106 and into a circular aperture in the vertical leg 104 of the expansion clips 100. In this manner, the expansion clip 100 can accommodate longitudinal movement of the inner sheet support members 84 relative to the roof trusses 80 upon expansion and contraction of the inner sheet support members 84.

The double-shell roof arrangement of the roof assembly 24 is essentially identical in construction and function to the double-shell wall arrangement. The double-shell roof arrangement therefore includes inner and outer shells 110 and 112 each of which is formed from interconnected corrugated sheets arranged relative to one another to permit both longitudinal and lateral expansion of the sheets. The sheets of the outer shell 112 are attached to the upper legs 92 of the roof purlins 82. The sheets of the inner shell 110 are attached to the horizontal legs 96 of the inner sheet support members 84. A layer of batt-type insulation 114 is sandwiched vertically between the inner and outer shells 110 and 112 and horizontally between the adjacent roof purlins 82 in essentially the same manner as discussed in Section 5 above in connection with the insulation 74 of the walls 14, 16, 18, and 20. Also as discussed above, an air gap 116 is formed between the upper surface of the insulation 114 and the outer shell 112 to provide additional resistance to heat transfer.

6. Construction and Operation of Bi-directional Expansion Joints

Each of the bi-directional expansion joints 150 is located at an intersection between a support beam and at least one supported beam supported on that support beam. In the case of the floor assembly 22, the support beams comprise the oven base support beams 30, and the supported beams comprise the floor support members 32. In the case of the roof assembly 24, the support beams comprise the roof trusses 80, and the supported beams comprise the roof purlins 82. In either case, the expansion joint 150 is designed to accommodate relative lateral and longitudinal movement between the support beam and the associated supported beam resulting from expansion of the support beam, the supported beam, and/or other components of the oven. Each of the expansion joints 150 also is designed to be simple and inexpensive to fabricate and to install.

Towards these ends, and as best seen in FIGS. 4 and 5, each of the bi-directional expansion joints 150 comprises a bracket having 1) a first portion bolted to the associated supported beam via a first set of slot-and-bolt arrangements that permits longitudinal movement of the supported beam relative to the bracket 150, and 2) a second portion bolted to the associated support beam via a second set of slot-and-bolt arrangements that permits lateral movement of the support beam relative to the bracket 150. Preferably, each of the slot-and-bolt arrangements includes 1) an elongated longitudinal or lateral slot 152 or 154 in the bracket 150, 2) a corresponding generally circular aperture formed in the associated support beam or supported beam, and 3) a corresponding bolt 158 or 160 that extends through the associated slot and the aperture so as to permit movement of the bracket 150 relative to the bolt 158 or 160 upon expansion or contraction of the associated support beam, supported beam, and/or other heated oven component. In the case of the floor assembly 22, the bi-directional expansion capability of the expansion joints 150 accommodates 1) longitudinal expansion of the oven support beams 32 and 2) lateral expansion of the inner floor shell 40 (and the resultant lateral movement of the oven support beams 32 relative to the oven base support beams 30). In the case of the roof assembly 24, the bi-directional expansion capability of the expansion joints 150 accommodates 1) longitudinal expansion of the roof purlins 82 and 2) lateral expansion of the roof trusses 80.

In the illustrated embodiment, each bracket 150 includes a simple L-bracket having a horizontal leg 162 and a vertical leg 164. The horizontal leg 162 is attached to an upper surface of the associated support beam (either the upper surface of the associated oven base support beam 30 of the floor assembly 22 or the upper surface of the associated roof truss 80 of the roof assembly 24) by the slot-and-bolt arrangements having lateral slots 154. The vertical leg 164 is attached to the vertical surface of at least one supported beam (either the floor support beam 32 of the floor assembly 22 or the roof purlin 82 of the roof assembly 22) by the slot-and-bolt arrangements having longitudinal slots 152. Because most or all of the brackets 150 are located at seams between ends of adjacent supported beams, the vertical legs 164 of these brackets 150 are connected to both of the longitudinally adjacent supported beams 32 or 82.

In operation, when the oven 10 is heated from a room temperature of approximately 70° F. to an operating temperature of about 350° F. to 500° F. or even higher, each of the support beams 30 or 80 and the supported beams 32 or 82 moves as much as 1⅛" to 2" due to thermal expansion of the beams 30, 80, and 82 as well as the inner floor shell 40 and possibly other heated components of the oven 10. This expansion results in both lateral and longitudinal movement between each of the support beams 30 or 80 and each of the intersecting supported beams 32 or 82. This relative movement is accommodated by the slot-and-bolt arrangements connecting the brackets 150 to the support beams and the supported beams, which permit lateral movement of the support beams 30 or 80 relative to the bracket 150 and which permit longitudinal movement of the supported beams 32 or 82 relative to the bracket 150.

Many changes can be made to the oven 10 described above without departing from the spirit of the invention. The scope of some of these changes are discussed above. The scope of other changes will become apparent from the appended claims. Moreover, the following terms shall have the following meanings in the claims:

"Longitudinally," "longitudinally of the oven," and the like shall not be limited to any particular direction of extension either in space or with respect to the long or short length of the oven. The term "longitudinally" is used only to provide a frame of reference with respect to "laterally".

"Laterally," "laterally of the oven," and the like should not be construed to require any particular direction of extension either in space or with respect to the long or short length of the oven. The term "laterally" is used only to denote a direction that extends perpendicularly or at least at a substantial angle with respect to "longitudinally."

A "support beam" refers to any structural support member of an oven that is capable of supporting another member. A support beam may or may not be supported on another structure.

A "supported beam" refers to any member of an oven that is supported on a support beam. A supported beam may or may not support another structure.

I claim:

1. An industrial oven comprising:

(A) a floor assembly;

(B) a plurality of insulated vertically-extending walls which are supported on said floor assembly; and (C) an insulated roof assembly which is disposed above said floor assembly and said walls, wherein at least one of said floor assembly and said roof assembly includes (1) a plurality of support beams which extend laterally of said oven, (2) a plurality of supported beams which extend longitudinally of said oven, which are disposed above said support beams, and which are supported on said support beams, and (3) a plurality of brackets which connect said supported beams to said support beams, said brackets permitting relative bi-directional movement between said support beams and said supported beams and each having first and second portions so as to accommodate significant relative lateral and longitudinal movement between said support beams and said supported beams resulting from thermal expansion of at least one of said support beams, said supported beams, and other oven components, wherein the amount of permissible lateral expansion accommodated by said first portion of each of said brackets is at least substantially proportional to the amount of permissible longitudinal expansion accommodated by the second portion thereof.

2. An oven as defined in claim 1, wherein (1) said first portion of each of said brackets is bolted to an associated supported beam via a first slot-and-bolt arrangement which permits longitudinal movement of said supported beam relative to said bracket, and (2) said second portion is bolted to an associated support beam via a second slot-and-bolt arrangement which permits lateral movement of said support beam relative to said bracket.

3. An oven as defined in claim 2, wherein each of said first and second slot-and-bolt arrangement comprises (1) an elongated slot in said bracket, (2) a generally circular aperture formed in a support beam or a supported beam associated with said slot, and (3) a bolt extending through said slot and into said aperture, said slot moving along said bolt upon movement of the support beam or the supported beam associated with said slot and-said-bolt arrangement.

4. An oven as defined in claim 1, wherein each said bracket has (1) at least one elongated longitudinal slot which is formed through said first portion thereof and through which said bracket is bolted to an associated supported beam and (2) at least one elongated lateral slot which is formed through said second portion thereof and through which said bracket is bolted to an associated support beam.

5. An oven as defined in claim 1, wherein each said bracket is L-shaped so as to have a vertical leg and a horizontal leg, said vertical leg having an elongated longitudinal slot which is formed therethrough and through which said bracket is bolted to an associated supported beam, and said horizontal leg having an elongated lateral slot which is formed therethrough and through which said bracket is bolted to an associated support beam.

6. An oven as defined in claim 5, wherein at least one of said brackets is located at a seam between first and second longitudinally adjacent supported beams, the vertical leg of said one bracket having (1) a first elongated longitudinal slot through which the vertical leg of said one bracket is bolted to said first supported beam and (2) a second elongated longitudinal slot through which the vertical leg of said one bracket is bolted to said second supported beam.

7. An oven as defined in claim 1, wherein said support beams are roof trusses, and said supported beams are roof purlins.

8. An oven as defined in claim 7, wherein said roof assembly includes said roof trusses, said roof purlins, a plurality of longitudinally-extending inner sheet support members mounted on said roof trusses, an inner roof shell mounted on bottoms of said inner sheet support members, an outer roof shell mounted on top of said roof purlins, and insulation sandwiched horizontally between said roof purlins and sandwiched vertically between said inner and outer roof shells.

9. An oven as defined in claim 8, wherein each of said roof trusses is I-shaped when viewed in transverse cross section, each of said roof purlins is generally Z-shaped when viewed in transverse cross section so as to have a vertical web, an upper horizontal leg extending in a first direction from a first side of said web, and a lower horizontal leg extending in a second direction from a second side of said web, and wherein each of said brackets is connected to said first side of the web of an associated roof purlin.

10. An oven as defined in claim 7, wherein each of said walls includes a plurality of vertical support columns which extend upwardly from said floor assembly, and wherein said roof trusses are mounted on said columns by slot-and-bolt arrangements that permit relative movement between said roof trusses and said columns so as to accommodate expansion of said roof trusses laterally of said oven.

11. An oven as defined in claim 1, wherein said support beams comprise oven base support beams, and said supported beams comprise floor support beams.

12. An oven as defined in claim 11, wherein said floor assembly includes said oven base support beams, said floor support beams, an inner floor shell mounted on top of said floor support beams, clips mounted on said oven base support beams, an outer floor shell mounted on said clips, and insulation sandwiched horizontally between said floor support beams and sandwiched vertically between said inner floor shell and said outer floor shell.

13. An oven as defined in claim 11, wherein each of said oven base support beams comprises an I-beam, wherein each of said floor support beams is generally C-shaped so as to have a vertical web, an upper horizontal leg extending outwardly from a first side of said web, and a lower horizontal leg extending outwardly from said first side of said web, and wherein each of said brackets is connected to a second side of the web of an associated floor support beam.

14. An oven as defined in claim 11, wherein each of said walls comprises a plurality of vertical support columns which extend upwardly from said oven base support beams and which support said roof assembly, and wherein said columns are anchored to said oven base support beams so as to essentially prevent relative movement therebetween.

15. An industrial oven comprising:

(A) a floor assembly;

(B) a plurality of insulated vertically-extending walls which are supported on said floor assembly; and (C) an insulated roof assembly which is disposed above said floor assembly and said walls, wherein each of said floor assembly and said roof assembly includes (1) a plurality of support beams which extend laterally of said oven, (2) a plurality of supported beams which extend longitudinally of said oven, which are disposed above said support beams, and which are supported on said support beams, and (3) a plurality of brackets which connect said supported beams to said support beams, said brackets permitting relative bi-directional movement between said support beams and said supported beams so as to accommodate relative lateral and longitudinal movement between said support beams and said supported beams resulting from thermal expansion of at least one of said support beams, said supported beams, and other oven components, wherein each said bracket is L-shaped so as to have a vertical leg and a horizontal leg, said vertical leg being connected to an associated supported beam by a first slot-and-bolt arrangement including a longitudinally extending slot, and said horizontal leg being connected to an associated support beam by a second slot and bolt arrangement including a laterally extending slot.

16. A roof assembly for an industrial oven, said roof assembly comprising:

(A) a plurality of roof trusses which are configured to extend laterally of the oven;

(B) a plurality of roof purlins which are configured to extend longitudinally of the oven, which are disposed above said roof trusses, and which are supported on said roof trusses; and (C) a plurality of brackets which connect said roof purlins to said roof trusses, said brackets permitting lateral and longitudinal movement between said roof trusses and said roof purlins so as to accommodate thermal expansion of said roof trusses laterally of the oven and thermal expansion of said roof purlins longitudinally of the oven, wherein the amount of permissible lateral expansion accommodated by each said bracket is substantially proportional to the amount of permissible longitudinal expansion accommodated by each said bracket.

17. A roof assembly as defined in claim 16, wherein each said bracket has (1) a first portion bolted to an associated roof purlin via a first slot-and-bolt arrangement which permits longitudinal movement of said roof purlin relative to said bracket, and (2) a second portion bolted to an associated roof truss via a second slot-and-bolt arrangement which permits lateral movement of said roof truss relative to said bracket.

18. A roof assembly as defined in claim 16, wherein each said bracket is L-shaped so as to have a vertical leg and a horizontal leg, said vertical leg having an elongated longitudinal slot which is formed therethrough and through which said bracket is bolted to an associated roof purlin, and said horizontal leg having an elongated lateral slot which is formed therethough and through which said bracket is bolted to an associated roof truss.

19. A roof assembly as defined in claim 16, wherein said roof assembly further comprises a plurality of longitudinally-extending inner sheet support members mounted on said roof trusses, an inner roof shell mounted on bottoms of said inner sheet support members, an outer roof shell mounted on top of said roof purlins, and insulation sandwiched horizontally between said roof purlins and sandwiched vertically between said inner and outer roof shells.

20. A floor assembly for an industrial oven, said floor assembly comprising:

(A) a plurality of oven base support beams which are configured to extend laterally of the oven, (B) a plurality of floor support beams which are configured to extend longitudinally of the oven, which are disposed above said oven base support beams, and which are supported on said oven base support beams, and (C) a plurality of brackets which connect said floor support beams to said oven base support beams, each of said brackets having first and second portions to permit relative longitudinal and lateral movement between an associated one of said oven base support beams and an associated one of said floor support beams, wherein the amount of permissible lateral movement accommodated by each of said brackets is substantially proportional to the amount of permissible longitudinal movement accommodated by each of said brackets.

21. A floor assembly as defined in claim 20, wherein each said bracket has (1) a first portion bolted to an associated floor support beam via a first slot-and-bolt arrangement which permits longitudinal movement of said floor support beam relative to said bracket, and (2) a second portion bolted to an associated oven base support beam via a second slot-and-bolt arrangement which permits lateral movement between said oven base support beam and said bracket.

22. A floor assembly as defined in claim 20, wherein each said bracket is L-shaped so as to have a vertical leg and a horizontal leg, said vertical leg having an elongated longitudinal slot which is formed therethrough and through which said bracket is bolted to an associated floor support beam, and said horizontal leg having an elongated lateral slot which is formed therethrough and through which said bracket is bolted to an associated oven base support beam.

23. An oven as defined in claim 20, wherein said floor assembly further comprises an inner floor shell mounted on top of said floor support beams, clips mounted on said oven base support beams, an outer floor shell mounted on said clips, and insulation sandwiched horizontally between said floor support beams and sandwiched vertically between said inner and outer floor shell.

24. An industrial oven comprising:

(A) a floor assembly including (1) a plurality of oven base support beams which extend laterally of said oven, (2) a plurality of floor support beams which extend longitudinally of said oven, which are disposed above said oven base support beams, and which are supported on said oven base support beams, (3) a first plurality of brackets which connect said floor support beams to said oven base support beams, wherein each of said first plurality of brackets is L-shaped so as to have a vertical leg and a horizontal leg, the vertical leg of each of said first plurality of brackets has a plurality of elongated longitudinal slots which are formed therethrough and through which said bracket is bolted to an associated floor support beam so as to accommodate expansion of the associated floor support beam longitudinally of said oven, and the horizontal leg of each of said first plurality of brackets has a plurality of elongated lateral slots which are formed therethrough and through which said bracket is bolted to an associated oven base support beam so as to permit lateral movement between the associated oven base support beam and the associated floor support beam, (4) an inner floor shell mounted on top of said floor support beams, (5) clips mounted on said oven base support beams, (6) an outer floor shell mounted on said clips; and (7) insulation sandwiched horizontally between said floor support beams and sandwiched vertically between said inner floor shell and said outer floor shell;

(B) a front wall, a rear wall, and a pair of side walls, each of said walls including (1) a plurality of vertical support columns each having a lower end immovably anchored to one of said oven base support beams and having an upper end, (2) an inner wall shell and an outer wall shell both fixed to said columns via at least one horizontally-extending girt, said girt being generally Z-shaped so as to have (a) a horizontal web which is attached to an associated plurality of said columns, (b) an inner leg which extends vertically from a first edge of said web in a first direction and on which said inner wall shell is mounted, and (c) an outer leg which extends vertically from a second edge of said web in a second direction and on which said outer wall shell is mounted, and (3) insulation sandwiched horizontally between said inner wall shell and said outer wall shell with an air gap being formed between said insulation and said outer wall shell; and (C) an insulated roof assembly which is disposed above said floor assembly and said walls, said roof assembly including (1) a plurality of roof trusses which extend laterally across said oven and which are supported on said upper ends of said columns by slot-and-bolt arrangements that permit relative movement between said roof trusses and said columns so as to accommodate lateral expansion of said roof trusses laterally of said oven, (2) a plurality of roof purlins which extend longitudinally across said oven, which are disposed above said roof trusses, and which are supported on said roof trusses, (3) a second plurality of brackets which connect said roof purlins to said roof trusses, wherein each of said second plurality of brackets is L-shaped so as to have a vertical leg and a horizontal leg, the vertical leg of each of said second plurality of brackets has a plurality of elongated longitudinal slots which are formed therethrough and through which said bracket is bolted to an associated roof purlin so as to accommodate expansion of the associated roof purlin longitudinally of said oven, and wherein the horizontal leg of each of said second plurality of brackets has a plurality of elongated lateral slots which are formed therethrough and through which said bracket is bolted to an associated roof truss so as to permit expansion of the associated roof truss laterally of said oven, (4) a plurality of longitudinally-extending inner sheet support members mounted on said roof trusses by slot-and-bolt arrangements that permit relative movement between said inner sheet support members and the associated roof trusses so as to accommodate expansion of said inner sheet support members longitudinally of said oven, (5) an inner roof shell mounted on bottoms of said inner sheet support members, (6) an outer roof shell mounted on top of said roof purlins, and (7) insulation sandwiched horizontally between said roof purlins and sandwiched vertically between said inner and outer roof shells with an air gap formed between said insulation and said outer roof shell.

* * * * *